US005529311A

United States Patent [19]

Johnson

[11] Patent Number: 5,529,311

[45] Date of Patent: Jun. 25, 1996

[54] INTERACTIVE COMMUNICATION APPARATUS

[76] Inventor: Robert D. Johnson, 3709 Ashford Leigh Ct., Charlotte, N.C. 28269

[21] Appl. No.: 512,987

[22] Filed: Aug. 9, 1995

Related U.S. Application Data

[63] Continuation of Ser. No. 394,445, Feb. 27, 1995, abandoned.

[51] Int. Cl.[6] ..... A63F 9/00

[52] U.S. Cl. ..... 273/440; 434/237

[58] Field of Search ..... 273/440; 434/237

[56] References Cited

U.S. PATENT DOCUMENTS

| | | | |
|---|---|---|---|
| Re. 279,984 | 4/1974 | Ravich | 434/237 |
| 3,235,263 | 2/1966 | Smith | 273/440 X |
| 3,390,469 | 7/1968 | Rader | 273/440 X |
| 3,484,105 | 12/1969 | Winston | 273/440 |
| 3,768,176 | 10/1973 | Huddleston | 434/237 |
| 4,692,119 | of/1987 | Ussery . | |
| 5,288,084 | 2/1994 | Miller | 434/237 X |

OTHER PUBLICATIONS

"The Mystery Box" Advertisement.

*Primary Examiner*—Paul E. Shapiro
*Attorney, Agent, or Firm*—Timothy R. Kroboth

[57] ABSTRACT

An interactive communication apparatus including a containing structure provided with a plurality of apertures to allow reaching within the containing structure to touch-contact an unknown object within the structure, is provided. The apparatus includes a plurality of partitions which divide the interior of the containing structure into spaces which are open to one another and into which the apertures open.

16 Claims, 4 Drawing Sheets

INTERACTIVE COMMUNICATION APPARATUS

CROSS REFERENCE TO RELATED APPLICATION

This application is a continuation of application Ser. No. 08/394,445 filed Feb. 2, 1995, abandoned.

FIELD OF THE INVENTION

This invention relates to an apparatus for interactive group communication, and in particular to an apparatus based upon the sense of touch.

BACKGROUND OF THE INVENTION

Critical decisions are often made based on limited information, or after having assessed an issue from only a few perspectives. As a consequence, considerations may be omitted that would result in different and wiser decisions.

It is clear that a diverse input of information from distinct sources should mold a decision that is wisely made. It is further clear that individuals need to appreciate the value of obtaining diverse input, and need to learn to effectively communicate with one another and to function as a team, in the decision-making process. Therefore, there is a need for an interactive group communication device that assists individuals, and in particular team members, in understanding and appreciating the value of diverse input as a key part of a decision-making process, that encourages effective group communication, and that builds effectively interacting teams.

SUMMARY OF THE INVENTION

In accordance with the present invention, there is provided an interactive communication apparatus which includes an enclosure for containing one or more selected objects to be identified by touch. The apparatus includes a first partition and a second partition partly dividing an interior of the enclosure into a first space, a second space adjacent to the first space, and a third space adjacent to the second space, such that the second space is open to the first space and to the third space. As a result, an object within the enclosure may extend from, or be passed from, the first space to the third space.

The enclosure is provided with a plurality of apertures for allowing reaching within the enclosure to touch-contact an unknown object. In a first embodiment, a first aperture is disposed in a first wall of the enclosure and opens into the first space, a second aperture is disposed in a second wall of the enclosure and opens into the second space, and a third aperture is disposed in the first wall and spaced apart from the first aperture, and opens into the third space. In a second embodiment, a first aperture is disposed in a first wall of the enclosure and opens into the first space, a second aperture is disposed in the first wall and spaced apart from the first aperture, and opens into the second space, and a third aperture is disposed in a second wall of the enclosure and opens into the third space.

An apparatus in accordance with the present invention, may include additional partitions, interior spaces, and apertures for access into the interior spaces. Beneficially attached to an inner wall surface and obstructing view into the enclosure through an aperture is a view-obstructing member through which a finger or hand may pass to reach into the enclosure.

Conveniently, the enclosure may include a removable wall member for inserting an object, and the partitions may be U-shaped dividers. If desired, the apertures may differ in size or shape, and the size may be selected to accommodate a finger or entire hand, or may be suitable for a child's hand but not an adult's hand.

In one form, the invention may be a kit that includes a containing structure for holding a selected object or objects, objects to be selected from, and materials for describing, depicting or reconstructing an object in two or three-dimensional form.

In the detailed description of the invention that follows, there are essentially described only preferred embodiments of this invention, simply by way of illustration of the best mode contemplated of carrying out this invention. As will be realized, this invention is capable of other and different embodiments, and its several details are capable of modification in various respects, all without departing from the invention. Accordingly, the drawing and the detailed description are to be regarded as illustrative in nature, and not as restrictive.

BRIEF DESCRIPTION OF THE DRAWING

Reference is now made to the accompanying drawing, which forms a part of the specification of the present invention.

DETAILED DESCRIPTION OF THE INVENTION

As indicated above, the present invention relates to an interactive group communication apparatus which helps individuals to understand and appreciate the value of obtaining diverse input in forming a decision, which encourages effective group communication, and which builds and strengthens effectively interacting teams. The apparatus is based upon gathering information using the sense of touch. The apparatus is useful as a learning or teaching device with children and adults.

Figure 1:
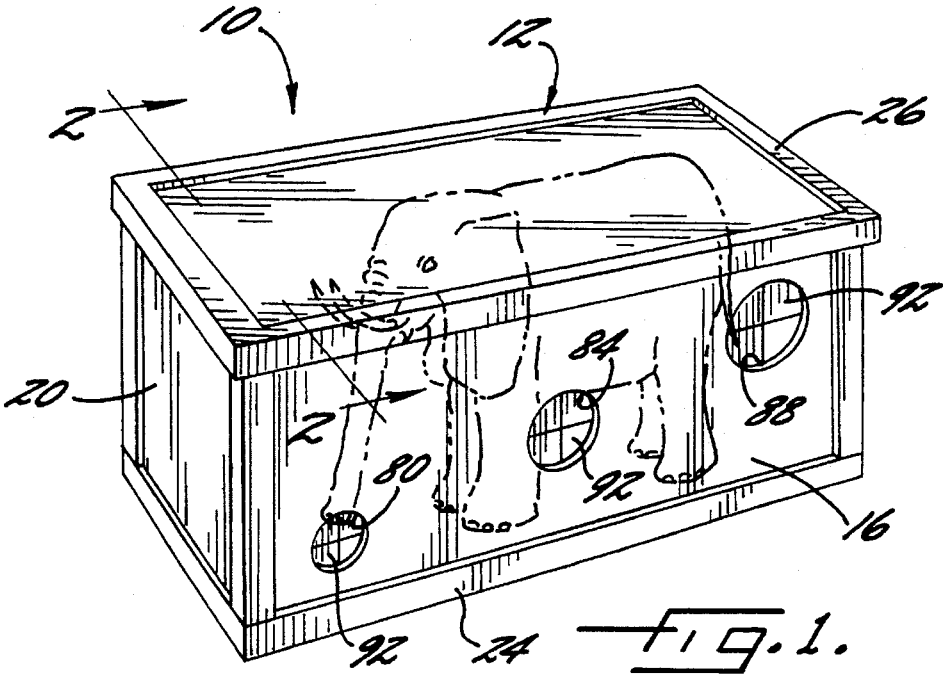
FIG. 1 is a perspective view of a preferred apparatus in accordance with the present invention.
Figure 2:
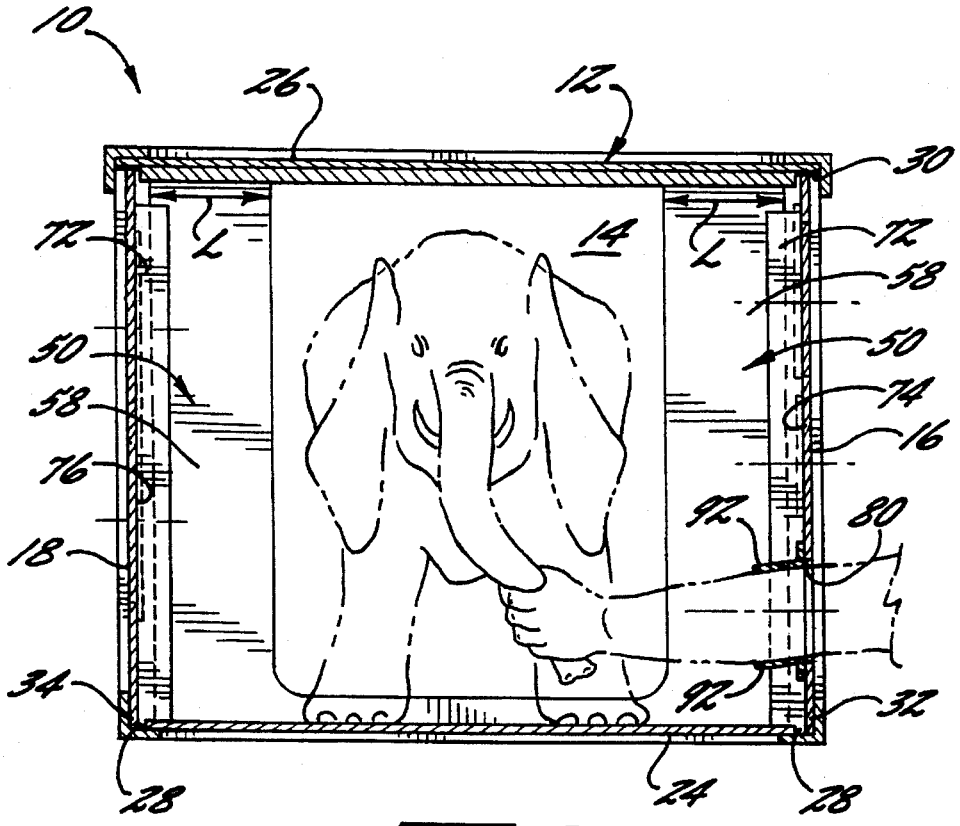
FIG. 2 is an enlarged cross-sectional view taken substantially along line 2—2 of FIG. 1.

Referring to FIGS. 1 to 6, a preferred group interactive communication apparatus 10 in accordance with the invention, includes a containing structure or enclosure 12 having an interior space 14 for containing a selected object, illustrated in phantom in FIGS. 1 and 2. The enclosure is formed by opposing wall members or side walls 16, 18, opposing wall members or end walls 20, 22, a wall member or base 24, and a wall member or top 26, which as shown, may be a removable lid.

Figure 3:
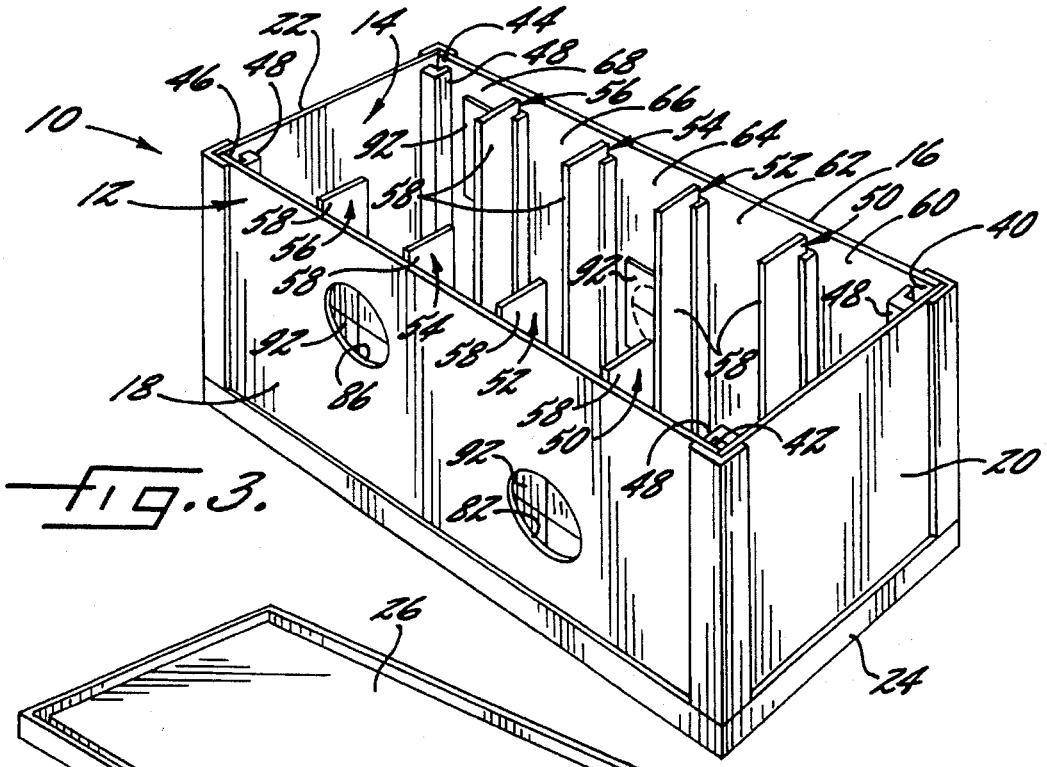
FIG. 3 is a perspective view of the containing structure of FIG. 1, with the top member removed to reveal additional details.
Figure 4:
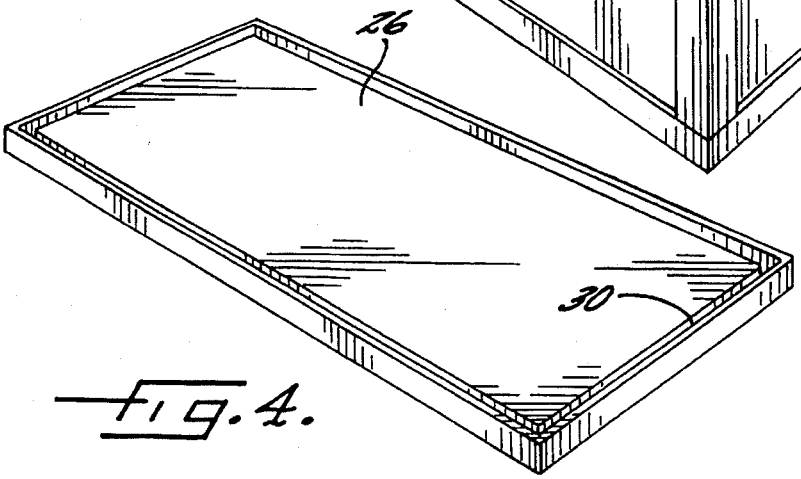
FIG. 4 is a perspective view of the removed top member, with the underside of the top member exposed.
Figure 5:
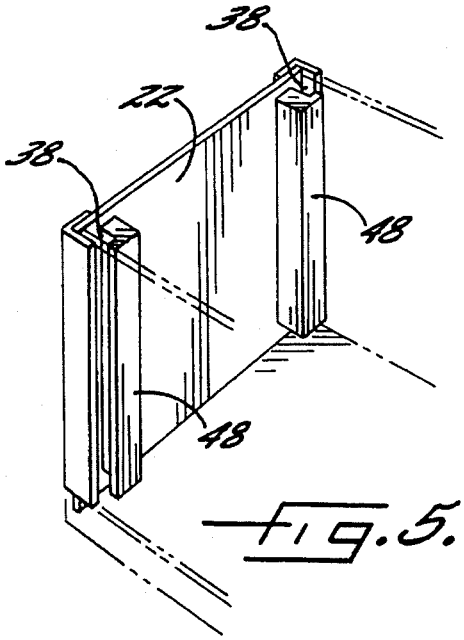
FIG. 5 is a detailed perspective view of an end wall of the containing structure of FIG. 3.

Beneficially, with further reference to FIG. 2, base 24 includes a peripheral groove 28, similar to peripheral groove 30 of the lid best shown in FIG. 4; and lower portions 32, 34 of the side walls and the lower portions of the end walls serve as ribs for a tongue-and-groove fit. Similarly, with particular reference to FIG. 3, end wall 20 advantageously includes vertical grooves into which end portions 40, 42 of the side walls fit, and with reference also to FIG. 5, end wall 22 includes vertical grooves 38 into which opposite end portions 44, 46 of the side walls fit. As shown, corner members 48 suitably attached to the end walls, may provide the vertical grooves.

In accordance with the invention, again referring to FIG. 3, partitions 50, 52, 54, 56, which partly divide interior space 14 into spaces 60, 62, 64, 66, 68, are disposed within the enclosure. It is a purpose of these partitions to define and to indicate the widthwise limits of the individual spaces within the enclosure, and yet allow these spaces to open to one another so that an object within the enclosure may extend from, or be passed from, space 60 to space 68. To an extent, however, a partition may limit reach from one space to an adjacent space; and to this end, and with particular reference to FIG. 2, a partition advantageously includes a leg portion 58 provided with a suitable length "L" which extends from one side wall in the general direction of the other side wall. As may be seen from FIGS. 2 and 3, each space extends lengthwise from one side wall to the other side wall.

Figure 6:
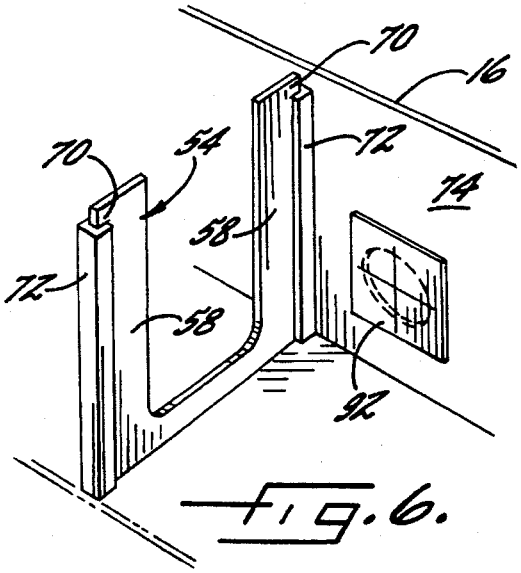
FIG. 6 is a detailed perspective view showing tongue-and-groove fit of a partition of the containing structure of FIG. 3.

With particular reference to FIG. 6, the side walls conveniently include vertical grooves into which partition side portions 70 opposite those extending toward the other side wall, fit. Referring also to FIG. 2, the vertical grooves may be provided by columns 72 attached to inner surfaces 74, 76 of the side walls. If desired, base 24 of the enclosure may include transverse grooves (not shown) for additional tongue-and-groove holding of the partitions.

As may be understood, reverse tongue-and-groove arrangements may be used in constructing the enclosure and securing the partitions. For instance, ribs could project from end walls 20, 22 and side walls 16, 18 could be provided with corresponding vertical grooves; or ribs could project from columns 72 and partition side portions 70 could be provided with the vertical grooves. Alternative joining or connecting methods may, of course, be used.

Conveniently, the partitions are U-shaped, in which case a partition has two legs, and each leg may limit reach or to indicate the limit of a particular space. A pair of L-shaped partitions could, of course, be used in place of a U-shaped partition. Furthermore, other partition shapes, for instance an O-shape, could be used. If desired, partitions of different shapes may be used in combination.

In accordance with the invention, side walls 16,18 include apertures 80, 82, 84, 86, 88, which respectively open into spaces 60, 62, 64, 66, 68. Beneficially attached to inner surfaces 74, 76 of the side walls and disposed for blocking view into the enclosure through the apertures are view-obstructing members 92, which yield to finger or hand pressure to each provide a secondary aperture through which, as shown in FIG. 2, a finger or hand passes to reach into the enclosure, and which are advantageously opaque to limit view into the enclosure. Conveniently, obstructing members 92 may be made of a flexible or resilient material so that the secondary aperture re-closes upon withdrawal of the finger or hand. Suitably, members 92 are cut or split as indicated in the drawing, to provide for pressure-induced formation of the secondary apertures. A suitable material for the view-obstructing members is soft so that abrasion of fingers or hands is avoided.

Apertures 80, 84, 88 are disposed in side wall 16, and apertures 82, 86 are disposed in side wall 18; and located near each aperture is a partition leg 58, and to both sides of each of apertures 82, 84, 86 are legs 58. Thus, aperture 80 opens through side wall 16 into space 60 defined by end wall 20 and partition 50, aperture 82 opens through side wall 18 into adjacent space 62 defined by partitions 50, 52, aperture 84 opens through side wall 16 into space 64 defined by partitions 52, 54, aperture 86 opens through side wall 18 into space 66 defined by partitions 54, 56, and aperture 88 opens through side wall 16 into space 68 defined by partition 56 and end wall 22.

Side wall 16 is beneficially free of an aperture that opens into space 62 or 66, and side wall 18 is beneficially free of an aperture that opens into space 60 or 64 or 68. As a result, a finger or hand may not enter a particular space also through an opposing side wall. Apertures 80, 84 in side wall 16 are spaced apart from one another by a distance that includes the width of space 62, into which aperture 82 opens. Thus, apertures in the same side wall may be spaced apart from one another by a distance that includes the width of the intervening space provided for an oppositely disposed aperture.

An enclosure in accordance with the invention, may be provided with less than or more than five apertures. Although there is no limit on the number of apertures, as a practical matter, an effective team tends to contain about four to six individuals, and too many apertures could be of little or no benefit. On the other hand, as few as three apertures could be used for a small group.

A variety of shapes and sizes may be used for the apertures. If desired, as shown in FIGS. 1 and 3, the apertures may be of the same shape but vary in size. Sizes may be used which accommodate a finger or entire hand, a child's hand but not an adult's hand, or a typical woman's hand but not a man's hand. Alternatively, the apertures may provide openings of substantially the same size (or square cm) but vary in shape. Illustrative shapes include round, oval and square shapes. If desired, apertures may differ in both size and shape.

In use, an unknown object of appropriate size is placed within enclosure 12 by a facilitator, and a team of suitable number is given the task of identifying the object by touch-contacting the object. Suitably, the side walls of enclosure 12 may be about 8"×15" in size, and the five spaces each may have a width of about 3"; this embodiment is especially useful for use by children, or to restrict an adult to use of less than his entire hand.

In the case of a five person team, each team member may be assigned an aperture of enclosure 12 for exploring a portion of the object by reaching through the aperture and making touch-contact with the object. As mentioned, the partitions serve to indicate the widthwise limits of an assigned space, and to some extent, limit reaching into an adjacent space. Using the diverse information obtained by touching the object through a number of differently located apertures, team members interactively communicate to decide on the identity of the object.

Variations of use are possible and include moving an object or objects from one end of enclosure 12 to the other end. In this case, one or more objects are placed into space 60 of enclosure 12, each team member touches and feels each object in succession, and then may place it in the appropriate adjacent space until the object reaches space 68 at the opposite end of the enclosure.

If desired, apertures of different size may be given different point values based upon relative size. For instance, a higher point value could be assigned to a larger aperture than to a smaller aperture, and a team could decide which apertures to use and not use, with correct identification of an object and a relatively smaller point total being an objective.

Objects that may be placed within enclosure 12 are virtually unlimited except for size and other obvious restrictions. Examples include large rubber animals such as an elephant, rhinoceros and dinosaur; constructed objects made from commercially available, construction toys for children; tools; and so forth.

Interactive communication may involve significant nonverbal communication, in which case team members may describe, depict or reconstruct an object in two or three-dimensional form. Useful materials for this purpose include paper and pencil, molding clay, commercially available, construction toys, pipe stem cleaners, and so forth. When sold as a kit, an apparatus in accordance with the present invention, may include such materials. If desired, a combination of verbal and nonverbal communication may be useful.

Figure 7A:
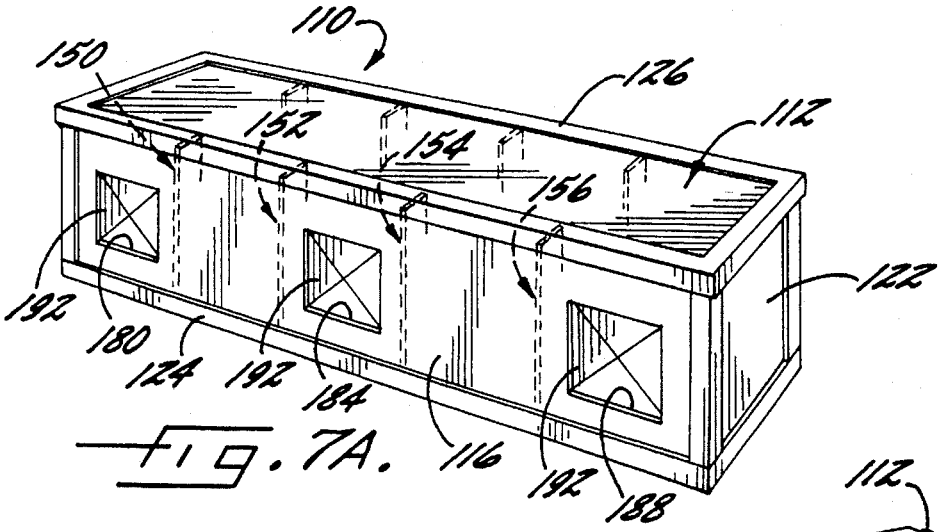
FIGS. 7A and 7B are perspective views of a second preferred embodiment of an apparatus in accordance with the present invention.
Figure 7B:
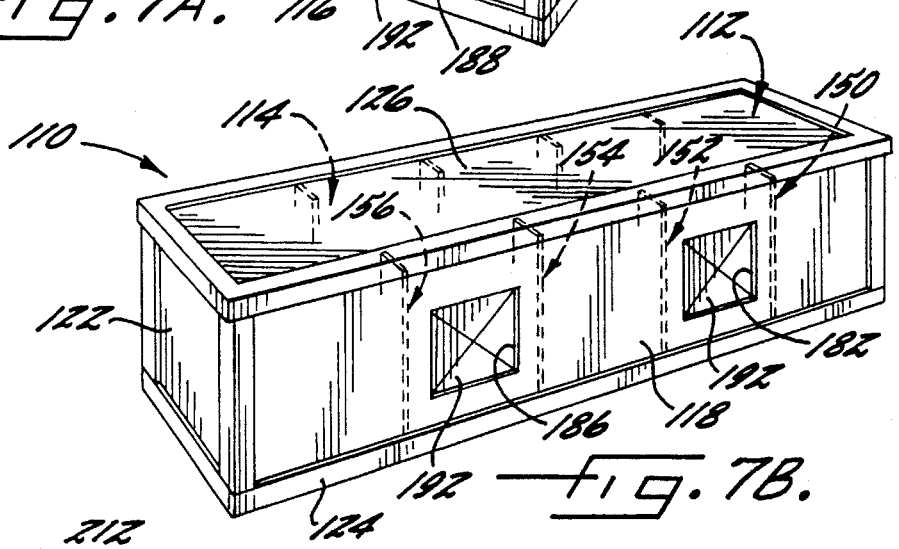

With reference to FIGS. 7A and 7B, a second preferred embodiment of an interactive communication apparatus in accordance with the present invention is shown, in which an enclosure 112 includes five apertures of substantially the same size, but of relatively larger size than the apertures of enclosure 12. The size of these apertures typically accommodates an entire adult hand; suitably, side walls 116, 118 of enclosure 112 may be about 8"×30" in size, and the five spaces each may have a width of about 6". Corresponding numerals are used in FIGS. 7A and 7B to indicate corresponding parts of the previously described apparatus, and the description of this embodiment is accordingly abbreviated.

Figure 8A:
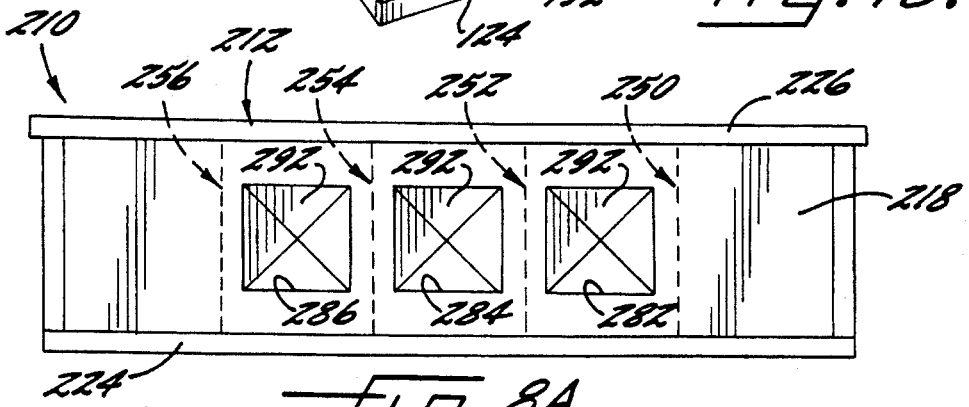
FIGS. 8A and 8B are side views of a third preferred embodiment of an apparatus in accordance with the present invention.
Figure 8B:
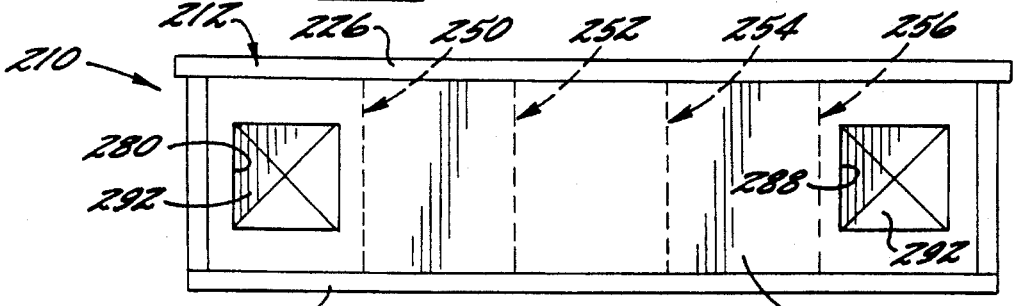

With reference to FIGS. 8A and 8B, a third preferred embodiment of the present invention is shown, in which an enclosure 212 includes apertures which open through the same side wall into adjacent spaces. Corresponding numerals are used in FIGS. 8A and 8B to indicate corresponding parts of apparatus 10, and the description of this third embodiment is accordingly abbreviated.

In this embodiment, enclosure 212 is provided with apertures 280, 282, 284, 286, 288, and apertures 280, 288 are disposed in a side wall 216 and apertures 282, 284, 286 are disposed in a side wall 218. Thus, aperture 280 opens through side wall 216 into a space defined by a partition 250 and an end wall, aperture 282 opens through side wall 218 into an adjacent space defined by partitions 250, 252, aperture 284 opens through side wall 218 into a space defined by partitions 252, 254, aperture 286 opens through side wall 218 into a space defined by partitions 254, 256, and aperture 288 opens through side wall 216 into a space 268 defined by a partition 256 and an end wall.

Figure 9A:
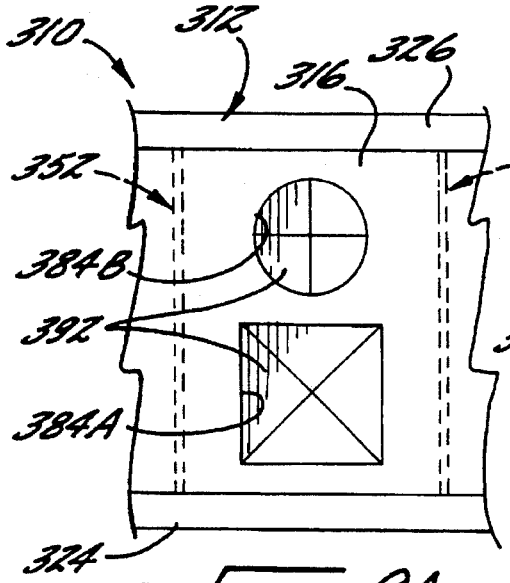
FIGS. 9A, 9B and 9C are partial views of a fourth preferred embodiment of an apparatus in accordance with the present invention.
Figure 9B:
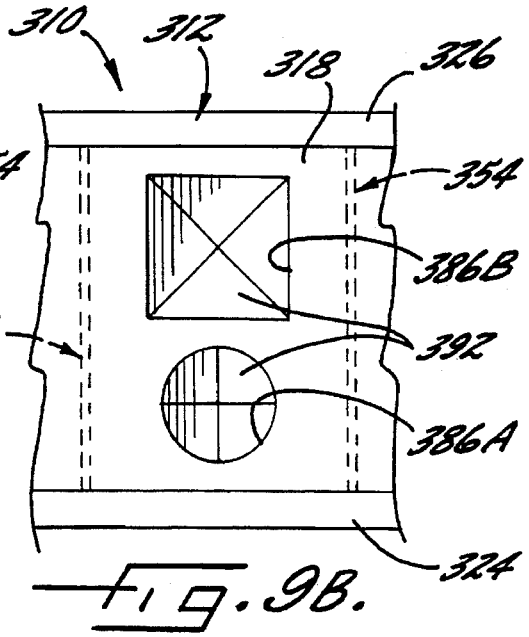
Figure 9C:
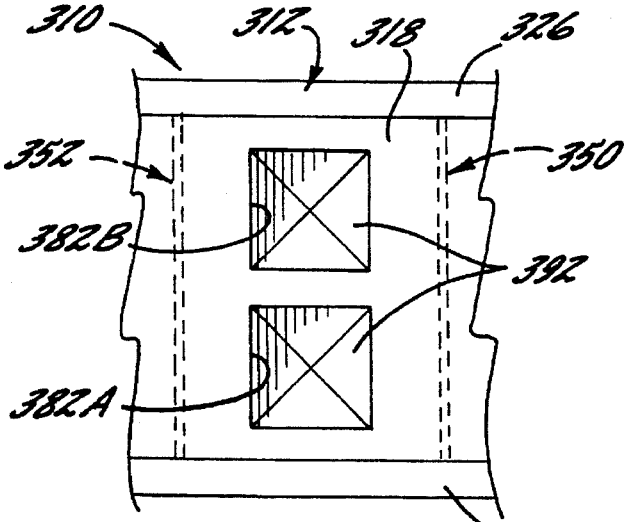

If desired, as shown in FIGS. 9A, 9B and 9C, a space may be accessible from more than one aperture in the same wall. FIGS. 9A, 9B and 9C illustrate three different stacked aperture arrangements for a fourth embodiment in accordance with the present invention. Corresponding numerals are used in these Figures to indicate corresponding parts of apparatus 10, and the description of this embodiment is accordingly abbreviated.

In FIG. 9A, a smaller sized aperture 384B is stacked above a larger sized aperture 384A. In FIG. 9B, a larger sized aperture 386B is stacked above a smaller sized aperture 386A. In FIG. 9C, the stacked apertures are of the same size. As shown, the stacked apertures may have the same shape or different shapes. Stacked apertures beneficially allow exploration of an unknown object from above and below, and allow a more complete perspective of the object. Increased exploration is especially useful for taller objects.

The first three embodiments may be modified to include stacked apertures. For instance, aperture 84 in FIG. 1 could replaced by stacked apertures, aperture 182 in FIG. 7B could be replaced by stacked apertures, or aperture 280 in FIG. 8B could be replaced by stacked apertures. Also, if desired, apertures could be located in an adjacent wall member, for instance, in a top wall member, rather than in an opposing wall member. For instance, with reference to FIG. 1, aperture 82 could be disposed in lid 26 in a suitable location for allowing exploration of space 62. The present invention may be carried out with other modifications without departing from the spirit or essential attributes thereof; and accordingly, reference should be made to the appended claims, rather than to the foregoing specification as indicating the scope of the invention.

I claim:

1. Interactive communication apparatus for use by at least two individuals, said apparatus comprising an enclosure adapted to contain at least one selected object to be identified by touch;

a first partition and a second partition partly dividing an interior of said enclosure into a first space, a second space adjacent to said first space, and a third space adjacent to said second space, wherein said second space is open to said first space and to said third space;

said enclosure being provided with a plurality of apertures, a first of which is disposed in a first wall of said enclosure, a second of which is disposed in a second wall of said enclosure, and a third of which is disposed in said first wall and is spaced apart from said first aperture;

wherein said first aperture opens into said first space, wherein said second aperture opens into said second space, and wherein said third aperture opens into said third space.

2. The interactive communication apparatus of claim 1, wherein said first wall and said second wall are opposing wall members.

3. The interactive communication apparatus of claim 1, wherein said enclosure comprises a removable wall member for inserting an object.

4. The interactive communication apparatus of claim 1, wherein said first partition is a U-shaped divider.

5. The interactive communication apparatus of claim 1, wherein at least two of said apertures differ in size.

6. The interactive communication apparatus of claim 1, wherein at least two of said apertures differ in shape.

7. The interactive communication apparatus of claim 1, wherein said apertures are of substantially the same size and shape.

8. The interactive communication apparatus of claim 1, wherein said enclosure further includes a fourth aperture, said fourth aperture being disposed in said second wall for opening into said second space.

9. The interactive communication apparatus of claim 1, further comprising a suitable object to be placed within the enclosure.

10. The interactive communication apparatus of claim 1, further comprising a suitable tangible medium for communicating to another participant a feature of an object within the enclosure.

11. The interactive communication apparatus of claim 1, wherein there is attached to said second wall, means for obstructing view through said second aperture and for yielding to pressure to provide touch contact with an object within said apparatus.

12. Interactive communication apparatus for use by at least two participants, said apparatus comprising an enclosure adapted to contain at least one selected object to be identified by touch;

a first partition and a second partition partly dividing an interior of said enclosure into a first space, a second space adjacent to said first space, and a third space adjacent to said second space, wherein said second space is open to said first space and to said third space;

said enclosure being provided with a plurality of apertures, a first of which is disposed in a first wall of said enclosure, a second of which is disposed in said first wall of said enclosure and is spaced apart from said first aperture, and a third of which is disposed in a second wall;

wherein said first aperture opens into said first space, wherein said second aperture opens into said second space, and wherein said third aperture opens into said third space.

13. The interactive communication apparatus of claim 12, wherein said first wall and said second wall are opposing wall members.

14. The interactive communication apparatus of claim 12, wherein said enclosure further includes a fourth aperture, said fourth aperture being disposed in said first wall for opening into said second space.

15. The interactive communication apparatus of claim 12, wherein there is attached to said second wall, means for obstructing view through said third aperture and for yielding to pressure to provide touch contact with an object within said apparatus.

16. Interactive communication apparatus for use by at least two participants, said apparatus comprising an enclosure adapted to contain at least one selected object to be identified by touch;

a first U-shaped partition and a second U-shaped partition partly dividing an interior of said enclosure into a first space, a second space adjacent to said first space, and a third space adjacent to said second space, wherein said second space is open to said first space and to said third space;

said enclosure being provided with a plurality of apertures, a first of which is disposed in a first wall of said enclosure, a second of which is disposed in a second wall of said enclosure, said first wall and said second walls being opposing walls, and a third of which is disposed in said first wall and is spaced apart from said first aperture;

wherein said first aperture opens into said first space, wherein said second aperture opens into said second space, and wherein said third aperture opens into said third space; and wherein there is attached to said second wall, an aperture-obstructing, flexible member which yields to pressure to provide touch contact with an object within said apparatus.

* * * * *